US007547120B2

(12) United States Patent
Wagener et al.

(10) Patent No.: US 7,547,120 B2
(45) Date of Patent: Jun. 16, 2009

(54) LIGHT REFLECTOR WITH A DEFINED CONTOUR SHARPNESS OF THE LIGHT DISTRIBUTION PRODUCED THEREBY

(75) Inventors: Harry Wagener, Alfeld (DE); Ruediger Kittelmann, Einbeck (DE)

(73) Assignee: Auer Lighting GmbH, Bad Gandersheim (DE)

( * ) Notice: Subject to any disclaimer, the term of this patent is extended or adjusted under 35 U.S.C. 154(b) by 0 days.

(21) Appl. No.: 11/748,823

(22) Filed: May 15, 2007

(65) Prior Publication Data

US 2007/0268706 A1 Nov. 22, 2007

(30) Foreign Application Priority Data

May 16, 2006 (DE) ..... 10 2006 023 120

(51) Int. Cl.
*F21V 7/04* (2006.01)

(52) U.S. Cl. ..... 362/348; 362/341; 362/346; 362/347; 362/350

(58) Field of Classification Search ..... None
See application file for complete search history.

(56) References Cited

U.S. PATENT DOCUMENTS

| | | | | |
|---|---|---|---|---|
| 3,700,883 | A * | 10/1972 | Donohue et al. | 362/518 |
| 4,021,659 | A * | 5/1977 | Wiley | 362/297 |
| 4,531,178 | A | 7/1985 | Uke | |
| 4,545,000 | A * | 10/1985 | Fraley et al. | 362/304 |
| 6,206,549 | B1 * | 3/2001 | Li | 362/297 |
| 6,361,175 | B1 * | 3/2002 | Kittelmann et al. | 359/851 |
| 2006/0083006 | A1 * | 4/2006 | Poel | 362/346 |

FOREIGN PATENT DOCUMENTS

| | | | |
|---|---|---|---|
| BE | 1014186 | A6 | 6/2003 |
| DE | 19801128 | A1 | 7/1999 |
| EP | 1 635 379 | A1 | 3/2006 |
| GB | 523215 | A | 7/1940 |
| WO | 9101468 | A1 | 2/1991 |

OTHER PUBLICATIONS

Den Haag, "Patent Application No. 07009598.9 European Search Report", Aug. 16, 2007, Published in: EP.

* cited by examiner

*Primary Examiner*—Sandra L O'Shea
*Assistant Examiner*—Danielle Allen
(74) *Attorney, Agent, or Firm*—DeMont & Breyer LLC

(57) ABSTRACT

The invention relates to a light reflector comprising a reflective surface having facets at least in sections, and a region for arranging at least one luminous means, wherein facets in a first region, closer to the region for arranging at least one luminous means, the region close to the luminous means, have a cylindrical shape, and facets in a second region, more remote from the region for arranging at least one luminous means, the region remote from the luminous means, have a spherical shape.

23 Claims, 6 Drawing Sheets

Figure 1:
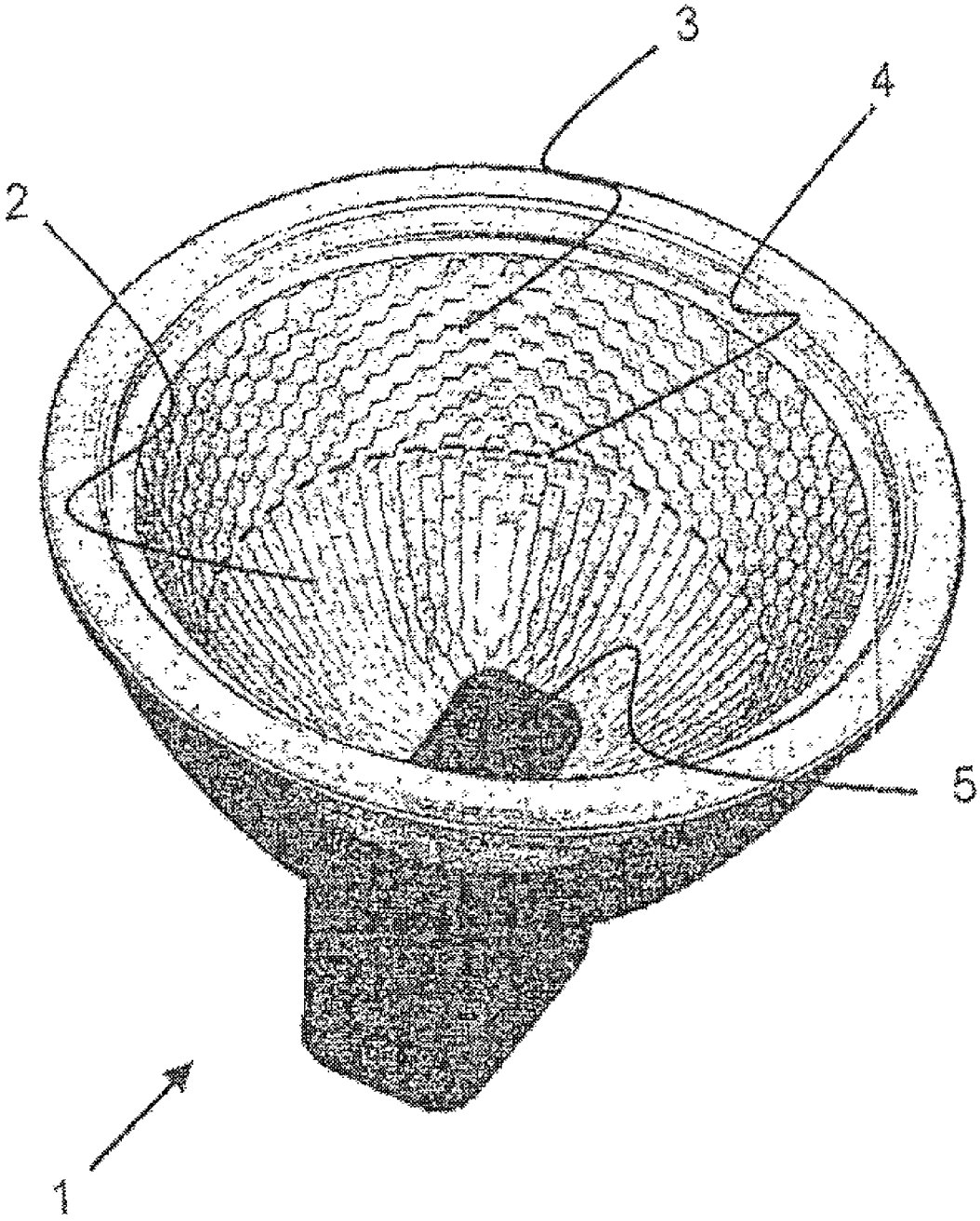

LIGHT REFLECTOR WITH A DEFINED CONTOUR SHARPNESS OF THE LIGHT DISTRIBUTION PRODUCED THEREBY

The invention relates to a light reflector, in particular a light reflector for luminaires and lighting units.

Light reflectors having a mostly cylindrically or rotationally symmetrical, concave body are known for illumination purposes, for example as spherical or as parabolic mirrors.

Reflectors having a faceted reflective surface are known. Thus, for example, U.S. Pat. No. 6,206,549 exhibits a light reflector having a surface that is faceted at least in sections.

EP 87 305 285 describes reflectors whose reflecting surfaces are covered at least partially with facets which have an elliptical circumference that respectively adjoins the elliptical circumference of neighboring facets and exposes between these a region of the original, unfaceted reflector surface that is intended overall to lead to lower scattering losses of these reflectors than occur in the case of reflectors whose facets adjoin one another directly hexagonally or in the shape of a diamond.

DE 102 29 782 discloses reflectors having variously shaped facet circumferences that are coated with a color-imparting coat applied by sputtering. The application of this colored coat by sputtering is intended to enhance its scratch resistance and to improve its appearance as compared to an internally applied lacquer coat. Although the circumference of these facets is illustrated graphically, the curvature of the respective facets is not described.

DE 199 10 192 describes reflectors whose reflective surface having facets is divided into sectors and lines. In the respective sectors and/or lines, the radii of the facet surfaces (here, the radii of spheres or cylinders), or the angle through which a column of facet surfaces extends, is selected such that the size of the solid angle at which the facet sees a luminous element arranged in the reflector, is taken into account. Given a larger solid angle, a correspondingly smaller curvature, and consequently a correspondingly larger radius, of the facet surface or its curvature is selected. The aim of this is, for example, to produce an oval light field instead of a round one. Equations are specified for the respective facet radii, but their calculation and fabrication are complicated and cost intensive. In particular, because of the requisite surface tolerances problems arise during fabrication in the demolding of hot formed reflector surfaces.

Apart from scattering losses and the geometry of the light field produced by a reflector, the sharpness of the contour of the light field is also an important criterion for its use. The sharpness of the perceptible contour at the boundary of a light bundle limiting angle is defined, for example, as values of K3 to K5 in DIN 5040-4 as a function of the illuminance gradient $S(\gamma)$, $\gamma$ being the angle of the emerging light relative to the axis of symmetry of the reflector, see DIN 5040-4, 1999-04, paragraph 5.4, for example. Reflectors having a contour sharpness K1, corresponding to $S(\gamma)>4$, have a sharply delimited bundle without any scattered light, whereas reflectors having a contour sharpness K5, corresponding to $S(\gamma)<0.5$, have a widely radiating bundle without a detectable contour.

The inventors have set themselves the task of creating a reflector and lighting units that are provided therewith and in whose case the sharpness of the contour of the light field can have values from K3 to K5, and yet the shape of the reflective surface is as simple as possible to calculate and can be effectively mastered in terms of production engineering, in particular in the case of hot forming.

Basic facet shapes that are, for example, spherical or cylindrical are suitable for the relatively simple calculation of a reflector shape.

Figure 4:
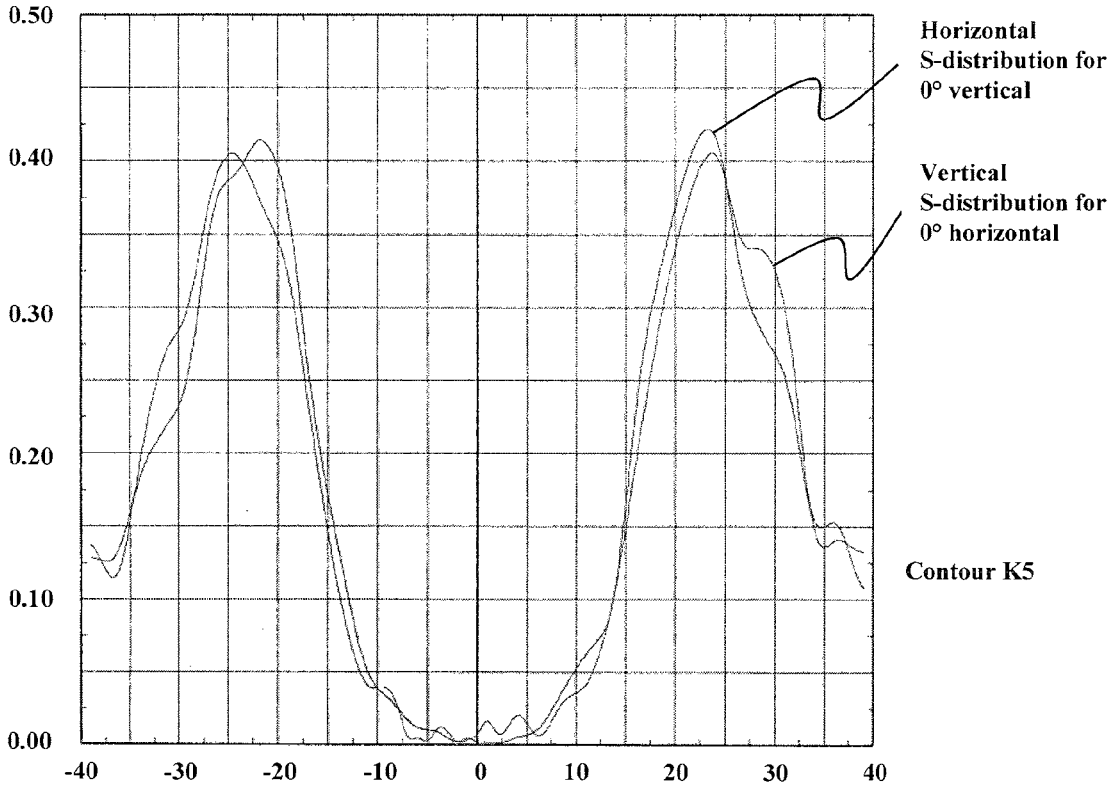

However, if only spherical facets, that is to say facets that have the shape of a spherical section, are used for reflectors, softly terminating light fields with typical contour sharpnesses of K5, see, for example FIG. 4 result, which allow scarcely any boundaries of the light field to be detected.

However, if use is made only of cylindrical facets, that is to say facets that substantially have the shape of a section of a circular cylinder that is generally arranged tangentially to the surface of the reflector and, for the purpose of more effective demolding, is arranged with a cylinder axis running substantially in the direction of the axis of symmetry of the reflector.

It is true that spherical facets have the advantage that the light field of a luminaire fitted with such a reflector terminates softly. However, a disadvantage is the relatively low illuminance of a luminaire or an illumination device fitted with such a reflector, which cause these to appear unsuitable for many applications, for example in film production, on stage and/or in a photographic studio. Furthermore, reflectors that have only spherical facets, in particular as glass reflectors, can be produced only very expensively.

Cylindrical facets have, by contrast, the advantage that a reflector that has only cylindrical facets having a cylinder axis substantially in the longitudinal direction of the reflector can certainly be effectively demolded as a rule when being hot formed, and also has a high illuminance; however, the light field of a luminaire provided with such a reflector generally terminates in such a hard fashion in the edge region that although it is possible thereby to produce tracking spotlights with contour sharpnesses K1 or K2 and a correspondingly strong directional effect, this light field is, however, not suitable for many applications, for example in film production, on stage and/or in a photographic studio.

The object of the invention is achieved simply by means of a light reflector as claimed in claim 1.

Particular embodiments and developments of the invention are to be gathered from the respective subclaims. In accordance with the invention, a light reflector is provided with a hollow body that has an opening. The invention is a hollow reflector that has a focal or midpoint region in which a luminous means can be arranged. Midpoint region is understood here as a region that lies in the vicinity or on the optical axis of the reflector and can be axially displaced relative to the focal point of the reflector.

In the case of such reflector types, a luminous means, for example an incandescent lamp, a high pressure discharge lamp or else an LED or else a number of LEDs can be arranged in the focal or midpoint region.

The invention relates to a reflector type whose reflective surface has faceting at least in sections.

In accordance with the invention, it is also possible to provide that the facets have, at least partially, in a first region, near the luminous means, a ratio of length to width that is larger than the ratio of length to width in a second region, remote from the luminous means. Thus, in accordance with the invention there are provided in the region that is located close to the luminous means substantially elongated facets that preferably extend radially in the direction of the midpoint region. The length/width ratio of the facets is preferably determined in this case with the aid of the plan view or the circumferential shape of the facets.

In one embodiment, the light reflector is distinguished by the fact that the first region, close to the luminous means, occupies between 5 and 70%, preferably between 10 and 50%, with particular preference between 20 and 35%, of the reflective surface.

A second region, which is located further removed from the light source, has faceting that, rather, exhibits facets of compact configuration, in particular spherical or square facets, for example. The invention also comprises reflectors that have yet further regions apart from a first region, close to the luminous means, and a second region, remote from the luminous means.

The inventors have discovered that it is possible with the aid of such a reflector type to combine the advantages of a light reflector with spherical facets, and the advantages of a light reflector with cylindrical facets. The result of the rear region, remote from the luminous means, with compact facets, for example spherical facets, is that the light field of a luminaire that is fitted with a reflector according to the invention terminates softly. The front region, closer to the luminous means, with the elongated facets, for example cylindrical facets, ensures that a luminaire with a reflector according to the invention has a high illuminance. In accordance with the invention, it is possible to provide a reflector with a light field that terminates softly and which, by contrast with a reflector having only cylindrical facets, uses only approximately 5% of luminous intensity. By contrast, known reflectors with spherical facets usually therefore have a 30 to 40% lower luminous intensity than reflectors configured with cylindrical facets.

It has turned out surprisingly that such a reflector can also be produced much more economically. In the case of known reflectors with spherical facets, it is extremely difficult to achieve an approximately spherical structure in the lower region, that is to say the one close to the luminous means. When glass is being hot pressed, the spherical shape in the region close to the luminous means is mostly at least partially lost again after pressing. By contrast, facets of elongated configuration are stable enough to be maintained even against the demolding forces. Thus, the invention enables the hot forming of a glass reflector that has a light field which terminates softly. In this case, the outlay on fabrication is not excessively higher than in the case of a light reflector with cylindrical facets. There is mostly no need for reworking, and this, in turn, lowers fabrication costs and ensures a high yield.

In one preferred embodiment of the invention, the hollow body, which determines the shape of the reflector, is a substantially cylindrically or rotationally symmetrical body, in particular a body having a substantially concave shape. In this case, all reflector types, for example, spherical, parabola-shaped or ellipsoidal reflector types, come into consideration for the initially unfaceted basic shape of the reflector. The configuration is determined in this case chiefly by the respective purpose of application.

In accordance with the invention, the facets are at least partially constructed in a convex and/or concave fashion. Thus, in particular, spherical facets and ones in the shape of circular cylindrical sections are covered, and in these cases the surface of the spherical or circular cylindrical shape both project from the body of the light reflector and project into the body of the light reflector.

In one preferred embodiment of the invention, the boundary between a first region, close to the luminous means, and a second region, remote from the luminous means, is formed along an imaginary line of section of the hollow body to a plane running perpendicular to the axis, or line, of symmetry, or the cylindrical or rotationally symmetrical axis or line of the hollow body. The light reflector is thus subdivided into a lower section that surrounds the luminous means or is provided for holding the light source, and an upper section that has compact faceting for the scattering of the light. A light field is thus produced that has a substantially cylindrically symmetrical or rotationally symmetrical intensity.

The light reflector according to the invention is defined by virtue of the fact that the boundary between the first region, close to the luminous means, and the second region, remote from the luminous means, subdivides the surface of the reflector for a contour sharpness value according to DIN 5040-4, April 1999, at an area ratio of approximately 1 to 4 for a value of K3, the factor 1 defining the area of the spherical facets and the factor 4 defining the area of the cylindrical facets, and subdivides it at an area ratio of approximately 1 to 1 for a value of K4.

Furthermore, the light reflector is defined by virtue of the fact that in the case of a contour sharpness according to DIN 5040-4, April 1999, for a value of K3 the radii of the spherical facets are approximately 0.67 to 1.0 times the focal length of the reflector, and the cylindrical facets define at least 48 subdivisions over the circular circumference, and for a value of K4 given a reflector with a focal length of 5.2 mm and a basic contour scattering of the reflector of approximately 15°, the scattering behavior thereof by cylinders and spheres is widened to 36 to 38°, the radii of the spherical facets being approximately 3.5 to 5 mm, and the cylindrical facets defining at least 48 subdivisions over the circular circumference.

The light reflector is further defined by virtue of the fact that in the case of a contour sharpness according to DIN 5040-4, April 1999, for a value of K3 given a reflector with a focal length of 5.2 mm and a basic contour scattering of the reflector of approximately 15°, the scattering behavior thereof by cylinders and spheres is widened to 36 to 38°, the radii of the spherical facets being approximately 3.5 to 5 mm, and the cylindrical facets defining at least 48 subdivisions over the circular circumference, and for a value of K4 given a reflector with a focal length of 5.2 mm and a basic contour scattering of the reflector of approximately 15°, the scattering behavior thereof by cylinders and spheres is widened to 36 to 38°, the radii of the spherical facets being approximately 3.5 to 5 mm, and the cylindrical facets defining at least 48 subdivisions over the circular circumference.

The above described basic contour scattering is yielded at least from the size of the luminous means and the focal length of the unfaceted reflector.

In one embodiment, the reflector has a maximum inside diameter of approximately 42 mm and a focal length that is, in particular, greater than 5.0 mm.

In a preferred way, in the case of the facets the ratio of length to width in the region close to the luminous means is more than twice, preferably more than three times, and with particular preference more than four times, the ratio of length to width of the facets in the region remote from the luminous means.

It is provided, in particular, to configure the region remote from the luminous means with facets whose ratio of length to width is approximately 1, that is to say spherical facets, for example. Consequently, the ratio of length to width in the region close to the luminous means then lies above 2, preferably above 3, and with particular preference above 4. The facets in the region close to the luminous means are then of elongated construction, and this leads to a sharply delimited bright light field.

The facets in the region remote from the luminous means preferably have at least partially a substantially spherical shape. The facets are thus constructed as spherical sections. It has emerged that such spherical shapes produce a light field that terminates softly.

In the region close to the luminous means, by contrast, the facets have an elongated shape, in particular a substantially circularly cylindrical shape. The facets are thus formed by circular cylindrical sections that preferably run tangential to the surface of the hollow body.

Alternatively, or in addition, it is provided to construct the facets at least partially as polyhedral sections. Thus, the facets can be formed, in particular, from polyhedral sections that approximate the previously described spherical or circularly cylindrical shapes. In particular, in this case regular or semi-regular polyhedral sections, with the aid of which a spherical shape can be approximated particularly effectively, come into consideration for the region, remote from the luminous means, with otherwise spherical facets.

The region close to the luminous means preferably has a fraction of 5 to 70%, preferably from 10 to 50%, and with particular preference from 20 to 35%, of the reflective surface. It has emerged that even a small region with elongated facets in the lower region of the reflector leads to the advantages according to the invention.

Depending on the arrangement of the facets, in preferred embodiments of the invention the circumferential shape of the facets in the region remote from the luminous means is substantially constructed in a polygonal, in particular square fashion, or in the shape of a regular hexagon. Specifically, the facets are preferably arranged in a substantially regular fashion such that corresponding plan views or circumferential shapes are produced.

In a particularly preferred embodiment of the invention, the facets are arranged in honeycomb fashion in the second region, remote from the luminous means, and configured as spherical facets. The facets therefore have a hexagonal plan view.

In the case of the elongated facets in the first region, close to the luminous means, the plan view or the circumferential shape is therefore also of substantially elongated configuration.

In one development of the invention, the light reflector has in the midpoint region, that is to say at the center, an opening for introducing a luminous means. Thus, a luminous means, for example an incandescent lamp or LED can be introduced from behind into the light reflector. The light reflector preferably has thereabove a receptacle for the luminous means.

In one preferred embodiment, the facets are grouped around the axis of symmetry of the reflector and run substantially radially, at least in the first region, close to the luminous means. Thus, elongated facets are provided that emanate in the shape of a star from an imaginary midpoint of the reflector.

The invention further relates to a luminaire having a light source or a luminous means and a light reflector according to the invention. In the case of the luminaire according to the invention, the preferably substantially cylindrical luminous means has a length of 2.5 to 3.5 mm which preferably extends axially relative to the axis of symmetry of the reflector, and has a diameter that is less than or equal to 1.5 mm. In one embodiment, the luminous means has a length of approximately 2.5 mm and a diameter of approximately 1 mm. In a further embodiment, the luminous means has a length of approximately 3.5 mm and a diameter of approximately 1.5 mm.

In one development of the invention, the luminaire is constructed such that the position of the light source is adjustable. In particular, the luminaire is provided with a reflector that is substantially configured as a concave axially symmetric solid of rotation or a cylindrically or rotationally symmetric body, and the light source is typically arranged at the center thereof. In accordance with the invention, the light source can be axially adjusted in the direction of the axis of symmetry. It is therefore possible to provide a luminaire with a variable light emergence angle.

The size of the light field varies with the adjustment of the light source. The luminaire can therefore be adapted to various requirements. It is possible to produce both a very bright small light field and a wider, somewhat darker light field. The adjustment of the light source along the axis of symmetry can be achieved both by means of an adjustable reflector and by means of an adjustable light source.

In a preferred way, the luminaire according to the invention can be used in film productions, on stage and in a photographic studio. It is particularly advantageous in this case that no hard light structures are produced by the softly terminating edges of the light field.

The invention is to be explained in more detail below with the aid of the exemplary embodiment illustrated in FIG. 1 to FIG. 3.

Figure 2:
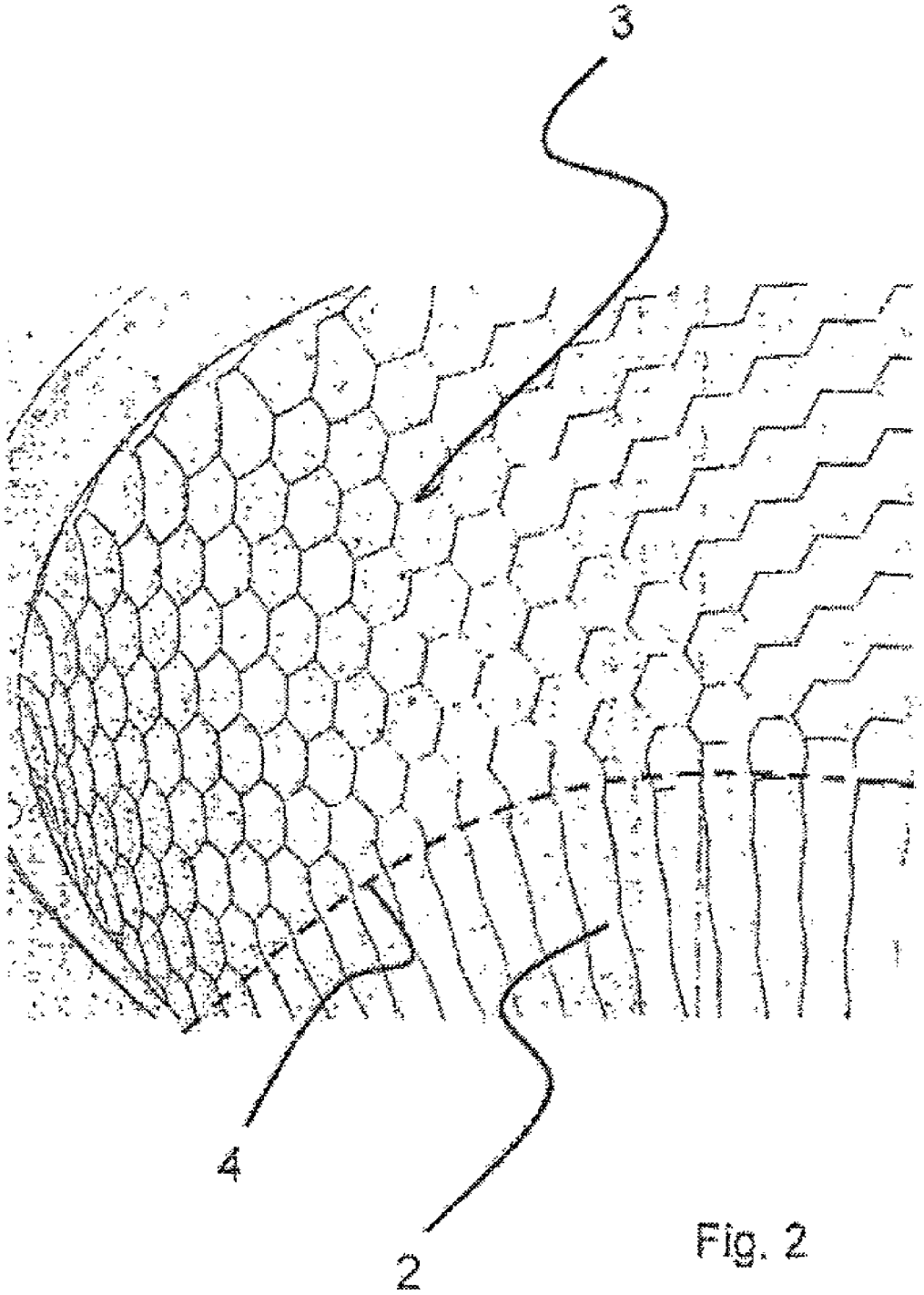
Figure 3:
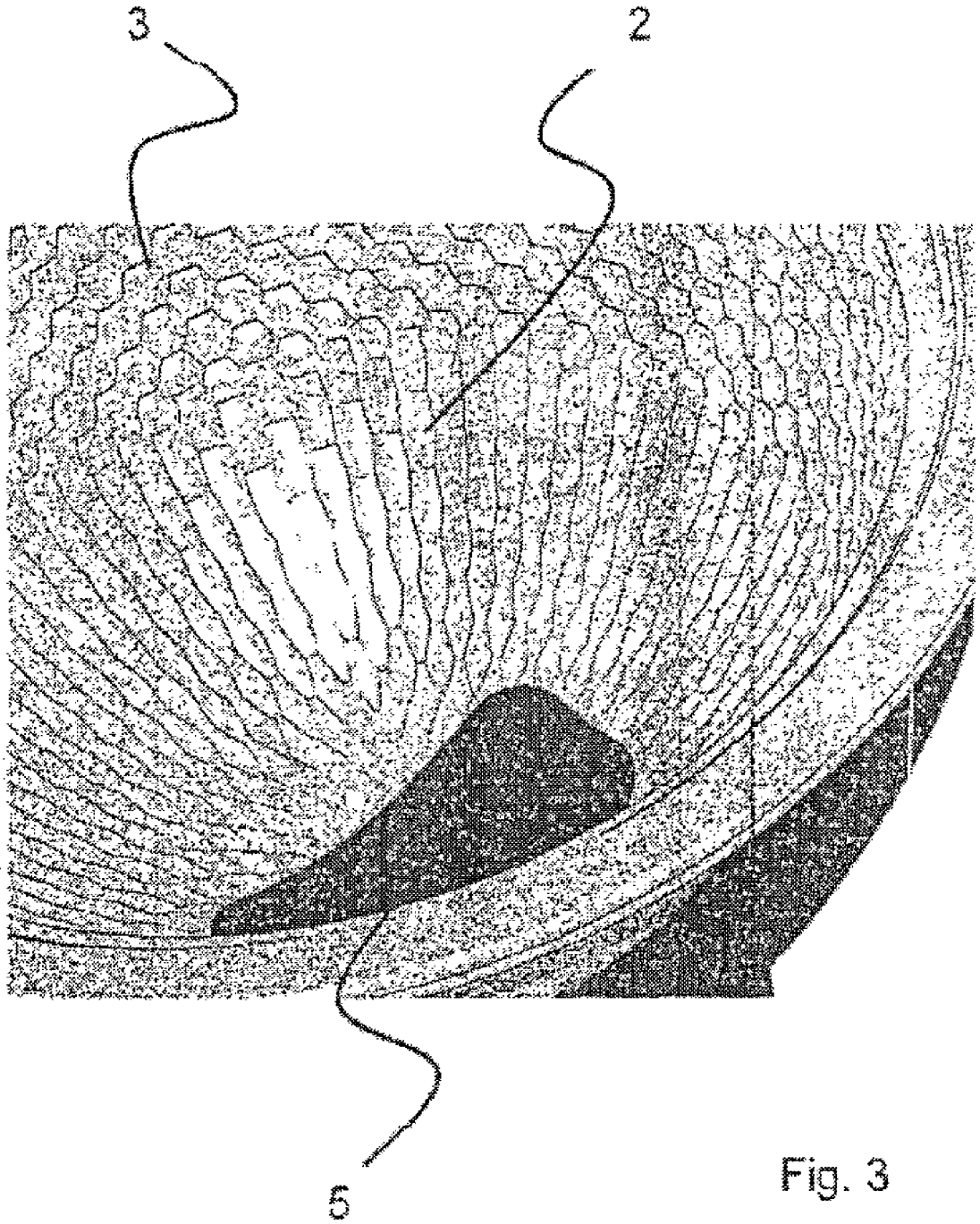
Figure 5:
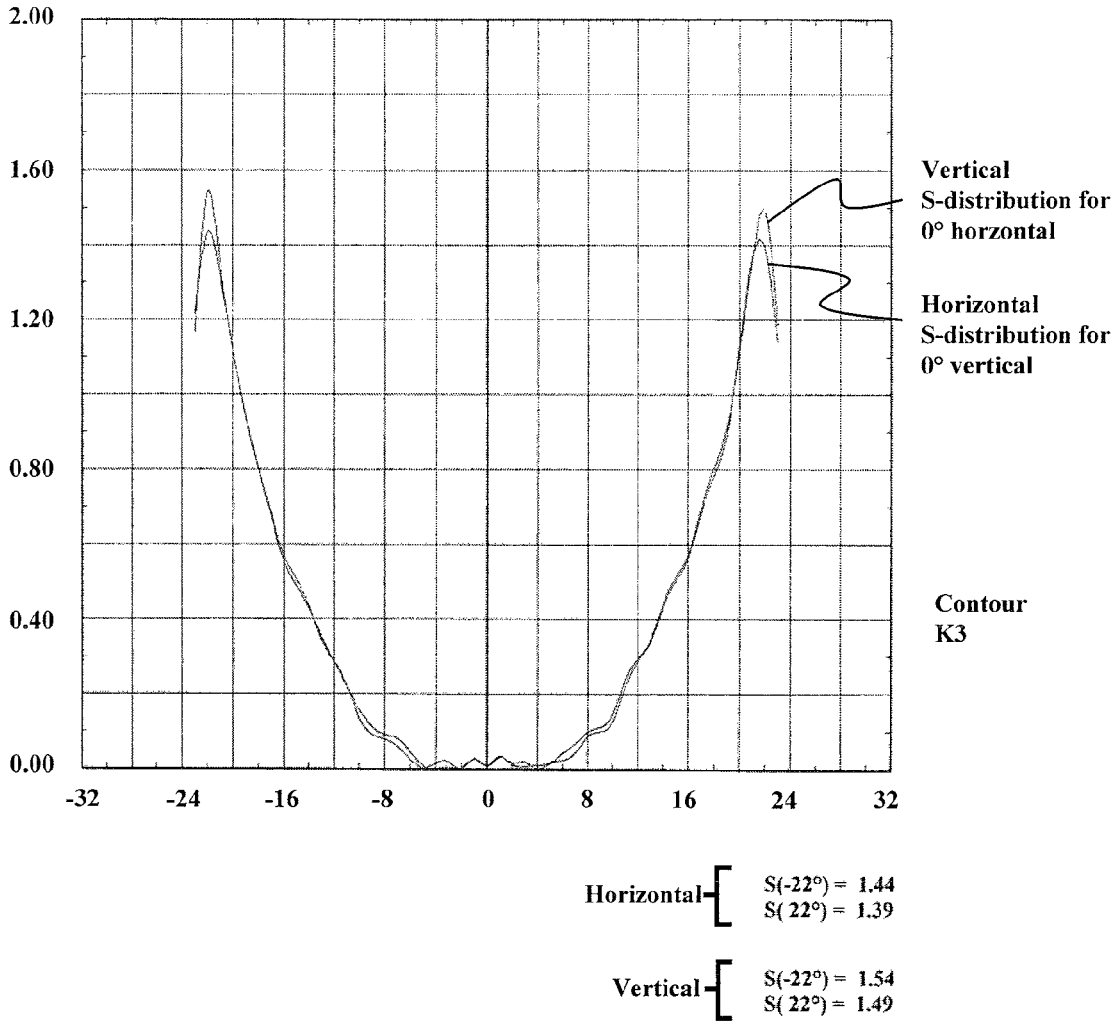
Figure 6:
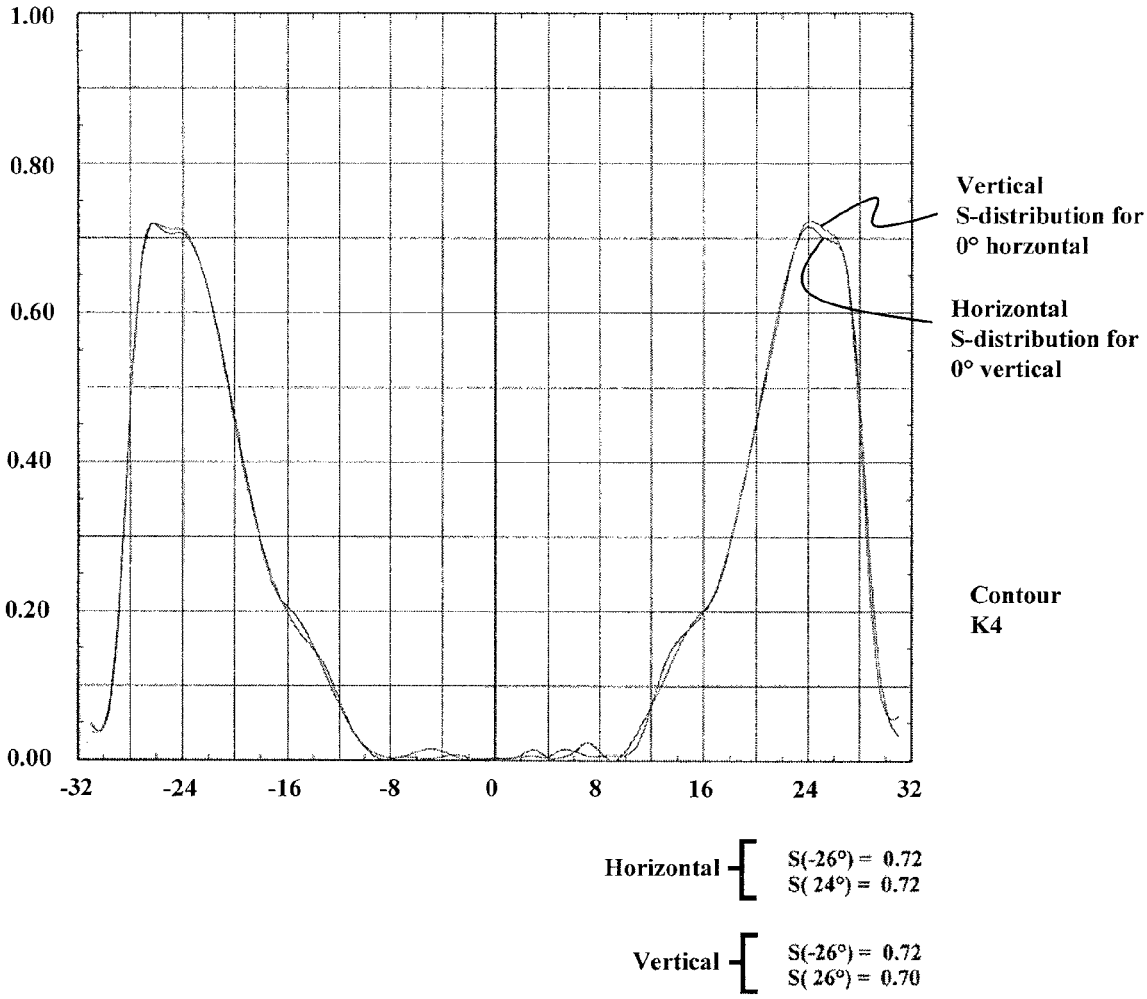

In the drawing:

FIG. 1 shows a perspective schematic view of an exemplary embodiment of a reflector according to the invention, FIG. 2 shows a detailed schematic view of a reflective surface of the reflector illustrated in FIG. 1, FIG. 3 shows a further detailed schematic view of the reflective surface of the reflector illustrated in FIG. 1, FIG. 4 shows a graph of the sharpness of the contour $S(\gamma)$ of a reflector that has only spherical facets, with a contour sharpness K5 corresponding to DIN 5040-4, FIG. 5 shows a graph of the sharpness of the contour $S(\gamma)$ of a reflector that has only cylindrical facets, with a contour sharpness K3 corresponding to DIN 5040-4, and FIG. 6 shows a graph of the sharpness of the contour $S(\gamma)$ of a reflector having a reflective surface according to the invention and a contour sharpness K4 according to DIN 5040-4.

DESCRIPTION OF PREFERRED EMBODIMENTS

Preferred embodiments of the reflectors according to the invention and of lighting units provided therewith are described below with reference to the attached figures.

In the present description, a cylindrical shape of a facet is understood as a section of a cylinder whose longitudinal axis corresponds approximately to a tangent of the basic shape of the reflector that, in the vicinity of this facet, in particular in the closest vicinity of this facet, bears against the reflector.

The basic shape of the reflector is understood in this case as the non-faceted reflector that can preferably have a spherical, elliptical or parabolic basic shape.

Furthermore, the axis of the section of a cylinder that defines the shape of the facet is intended, if nothing else is specified in the description of specific embodiments, to lie in a plane in which the optical axis of the reflector also lies. As a result, when the reflector is viewed from the front, that is to say against the direction of its light propagation, such cylindrical facets have the appearance of radial, spoke-shaped sections.

FIG. 1 shows a perspective schematic view of an exemplary embodiment of a reflector 1 according to the invention.

The reflector 1 is configured as a substantially cylindrically or rotationally symmetrical body at whose center there is arranged a receptacle 5 for a luminous means that defines a midpoint region.

In the lower region of the reflector 1, that is to say in the region 2 close to the luminous means, the reflector surface has facets that substantially have the shape of cylindrical sections running tangential to the surface.

These cylindrical facets emanate approximately in the shape of a star from the midpoint region. The boundary of an upper region 3, remote from the luminous means, is formed along a dashed line 4 that runs along an imaginary line of intersection of a plane (not demonstrated) running approximately perpendicular to the axis of symmetry.

The surface of the reflector has facets, which have a substantially spherical shape, in the region 3 remote from the luminous means. The spherical facets are arranged in honeycomb fashion and, because of their mutually overlapping spherical sections, have a plan view that corresponds approximately to a regular hexagon.

FIG. 2 shows a detailed schematic view of the reflector shown in FIG. 1. Chiefly to recognize is the upper region 3, remote from the luminous means, which has spherical facets that are arranged in honeycomb fashion. The region close to the luminous means, which has elongated facets approximately having the shape of circular cylindrical sections begins below a boundary that is indicated by a dashed line 4.

FIG. 3 shows a further detailed schematic view of the reflector shown in FIG. 1, which chiefly shows the lower region 2, close to the luminous means, which extends up to the receptacle 5 for a luminous means (not illustrated). The cylindrical facets are longer at the other boundary than in the vicinity of the receptacle 5, because of the tangential alignment of the cylindrical facets in the region 2 close to the luminous means, and of the curvature of the reflector, which increases toward the midpoint.

FIGS. 4 to 6 respectively show a graph of the sharpness of the contour S(γ) of a reflector of different faceting and contour sharpness. Shown here respectively in detail are the horizontal S distribution and the vertical one, as a function of the angle, specified in degrees as unit. In addition, FIGS. 5 and 6 further specify individual pairs of value in the region of the respective maxima of the distributions.

FIG. 4 shows a graph of the sharpness of the contour S(γ) of a reflector that has only spherical facets, with a contour sharpness K5 corresponding to DIN 5040-4. The profile verifies the softly terminating light field of spherical facets. By contrast, FIG. 5 shows a graph of the sharpness of the contour S(γ) of a reflector that has only cylindrical facets, with a contour sharpness K3 corresponding to DIN 5040-4. The profile shown verifies the hard terminating light field of the cylindrical facets.

FIG. 6 shows a graph of the sharpness of the contour S(γ) of a reflector having a reflective surface according to the invention and a contour sharpness K4 according to DIN 5040-4. The profile verifies the advantages of the two individual types shown above, in a single reflector.

In one embodiment, the boundary between the first region, close to the luminous means, and the second region, remote from the luminous means, subdivides the surface of the reflector for a contour sharpness value according to DIN 5040-4, April 1999, at an area ratio of approximately 1 to 4 for a value of K3, the factor 1 defining the area of the spherical facets and the factor 4 defining the area of the cylindrical facets, and subdivides it at an area ratio of approximately 1 to 1 for a value of K4.

In the case of a contour sharpness according to DIN 5040-4, April 1999, for a value of K3 the radii of the spherical facts are approximately 0.67 to 1.0 times the focal length of the reflector, and the cylindrical facets define at least 48 subdivisions over the circular circumference, and for a value of K4 given a reflector with a focal length of 5.2 mm and a basic contour scattering of the reflector of approximately 15°, the scattering behavior thereof by cylinders and spheres is widened to 36 to 38°, the radii of the spherical facets being approximately 3.5 to 5 mm, and the cylindrical facets defining at least 48 subdivisions over the circular circumference.

in the case of a contour sharpness according to DIN 5040-4, April 1999, for a value of K3 given a reflector with a focal length of 5.2 mm and a basic contour scattering of the reflector of approximately 15°, the scattering behavior thereof by cylinders and spheres is widened to 36 to 38°, the radii of the spherical facets being approximately 3.5 to 5 mm, and the cylindrical facets defining at least 48 subdivisions over the circular circumference, and for a value of K4 given a reflector with a focal length of 5.2 mm and a basic contour scattering of the reflector of approximately 15°, the scattering behavior thereof by cylinders and spheres is widened to 36 to 38°, the radii of the spherical facets being approximately 3.5 to 5 mm, and the cylindrical facets defining at least 48 subdivisions over the circular circumference.

It is evident to the person skilled in the art that the above described embodiments are to be understood by way of example. The invention is not restricted to these, but can be varied in manifold ways without departing from the spirit of the invention.

The invention claimed is:

1. A light reflector comprising:

a reflective surface having facets at least in sections; and a region for arranging at least one luminous means;

wherein said light reflector is defined by cylindrical-shaped facets in a first region and spherical-shaped facets in a second region, said first region being closer than said second region to the region for arranging at least one luminous means.

2. The light reflector as claimed in claim 1, wherein the boundary between the first region and the second region is approximately along the line of intersection of a plane running perpendicular to the axis of symmetry of the light reflector.

3. The light reflector as claimed in claim 1, wherein the first region occupies between 5 and 70% of the reflective surface.

4. The light reflector as claimed in claim 2, wherein the boundary between the first region and the second region is defined by:

i) a first subdivision of the reflective surface, said first subdivision being defined by an area ratio of approximately 1 to 4, the factor 1 defining the area of the spherical-shaped facets and the factor 4 defining the area of the cylindrical-shaped facets, said subdivision being configured to achieve a first contour sharpness value, and ii) a second subdivision of the reflective surface, said second subdivision being defined by an area ratio of approximately 1 to 1 of the area of the spherical-shaped facets and the area of cylindrical-shaped facets, said subdivision being configured to achieve a second counter sharpness value.

5. The light reflector as claimed in claim 4, wherein the radius of each of the spherical-shaped facets in the first subdivision is approximately 0.67 to 1.0 times a focal length of the light reflector, and the cylindrical-shaped facets define at least 48 subdivisions over the circular circumference to achieve the first contour sharpness value, and the radius of each of the spherical-shaped facets in the second subdivision is approximately 3.5 to 5 mm, and the cylindrical-shaped facets defining at least 48 subdivisions over the circular circumference to achieve the second contour sharpness value for the light reflector having focal length of 5.2 mm and a basic contour scattering of the light reflector of approximately 15°, thereby widening the scattering behavior of cylinders and spheres to 36 to 38°.

6. The light reflector as claimed in claim 4, wherein the radius of each of the spherical-shaped facets is approximately 3.5 to 5 mm, and the cylindrical-shaped facets defining at least 48 subdivisions over the circular circumference to achieve the first contour sharpness value for the light reflector having a focal length of 5.2 mm and a basic contour scattering of the reflector of approximately 15°, thereby widening the scattering behavior of cylinders and spheres is widened to 36 to 38°.

7. The light reflector as claimed in claim 3, wherein the light reflector has a maximum inside diameter of approximately 42 mm and a focal length that is greater than 5.0 mm.

8. The light reflector as claimed in claim 1, wherein the ratio of length to width of the cylindrical-shaped facets in the first region is more than 2 times as large as the ratio of length to width of the spherical-shaped facets in the second region.

9. The light reflector as claimed in claim 1, wherein at least a portion of the cylindrical-shaped facets and spherical-shaped facets define polyhedral sections.

10. The light reflector as claimed in claim 9, wherein at least a portion of the spherical-shaped facets in the second region define regular or semiregular polyhedral sections.

11. The light reflector as claimed in claim 1, wherein the spherical-shaped facets and the cylindrical-shaped facets are at least partially constructed in at least one of a convex and concave fashion.

12. The light reflector as claimed in claim 1, wherein the light reflector is constructed in at least one of a-spherical, parabola-shaped, and ellipsoidal fashion.

13. The light reflector as claimed in claim 1, wherein the circumferential shape of the spherical-shaped facets in the second region is substantially constructed in a polygonal fashion.

14. The light reflector as claimed in claim 1, wherein the circumferential shape of the cylindrical-shaped facets in the first region is substantially constructed in an elongated fashion.

15. The light reflector as claimed in claim 1, wherein the spherical-shaped facets in the second region are substantially arranged in honeycomb fashion relative to one another.

16. The light reflector as claimed in claim 1, wherein the light reflector has at least one second opening, substantially arranged in the midpoint area, for introducing a luminous means.

17. The light reflector as claimed in claim 2, wherein the cylindrical-shaped facets are grouped around the axis of symmetry of the light reflector and arranged radially.

18. A luminaire comprising:

at least one luminous means;

and at least one light reflector that comprises:

a reflective surface having facets at least in sections, and a region for arranging at least one luminous means, wherein said light reflector is defined by cylindrical-shaped facets in a first region and spherical-shaped facets in a second region, said first region being closer than said second region to the region for arranging at least one luminous means.

19. The luminaire as claimed in claim 18, wherein the luminous means has a length of 2.5 to 3.5 mm and has a diameter that is less than or equal to 1.5 mm.

20. The luminaire as claimed in claim 18, wherein the luminous means has a length of approximately 2.5 mm and a diameter of approximately 1 mm.

21. The luminaire as claimed in claim 18, wherein the luminous means has a length of approximately 3.5 mm and a diameter of approximately 1.5 mm.

22. The luminaire as claimed in claim 18, wherein the position of the luminous means is axially adjustable along the optical axis of the reflector.

23. The luminaire as claimed in claim 18, wherein the reflector is configured as a substantially concave, cylindrically or rotationally symmetrical body, and the luminous means is arranged adjustably in the direction of the axis of cylindrical or rotational symmetry of the reflector.

* * * * *